US005235243A

United States Patent [19]

Tong

[11] Patent Number: 5,235,243

[45] Date of Patent: Aug. 10, 1993

[54] EXTERNAL MAGNETIC SHIELD FOR CRT

[75] Inventor: Hua S. Tong, Mundelein, Ill.

[73] Assignee: Zenith Electronics Corporation, Glenview, Ill.

[21] Appl. No.: 530,037

[22] Filed: May 29, 1990

[51] Int. Cl.[5] ..... H01J 31/00

[52] U.S. Cl. ..... 313/479; 313/313; 313/402; 315/85; 174/35 MS

[58] Field of Search ..... 313/313, 479, 160, 477 R, 313/402; 315/85; 174/35 MS; 358/245

[56] References Cited

U.S. PATENT DOCUMENTS

| | | | |
|---|---|---|---|
| 3,345,537 | 10/1967 | Spencer | 313/85 |
| 3,959,152 | 4/1976 | Lill et al. | 358/245 |
| 4,556,821 | 12/1985 | Cooper | 313/160 |
| 4,930,015 | 5/1990 | Dougherty et al. | 313/477 R |

FOREIGN PATENT DOCUMENTS

| | | | |
|---|---|---|---|
| 0140964 | 12/1978 | Japan | 313/479 |
| 0103238 | 6/1982 | Japan | 313/479 |
| 0222124 | 12/1983 | Japan | 313/35 MS |

*Primary Examiner*—Donald J. Yusko
*Assistant Examiner*—N. D. Patel

[57] ABSTRACT

A cathode ray tube has an external magnetic shield adapted for tight fitting positioning upon and about the funnel portion of the CRT. The external magnetic shield includes a shell preferably of conventional plastic and a soft magnetic material having high permeability and low coercivity. The soft magnetic material may be either disposed as a layer on the surface of the shell or distributed throughout the shell in the form of small particles. The external magnetic shield is installed over the CRT funnel following CRT evacuation and frit-sealing for improved magnetic shielding in a low cost, easily assembled magnetic shielding arrangement.

7 Claims, 2 Drawing Sheets

EXTERNAL MAGNETIC SHIELD FOR CRT

BACKGROUND OF THE INVENTION

This invention relates generally to cathode ray tubes (CRTs) and is particularly directed to an external magnetic shield for a CRT.

Electron beam positioning on the faceplate of a CRT is controlled by a dynamic magnetic field applied to the electron beam (or beams) by means of a deflection yoke. Part of the manufacturing process of a multi-beam color CRT involves aligning the electron beams so that they are each incident upon their associated phosphor elements on the inner surface of the CRT's faceplate. Changes in applied external magnetic field, e.g., the earth's magnetic field, causes re-alignment of the electron beams from their initial positions and degraded color purity of the CRT's video image. To accommodate changes in the external magnetic field such as encountered if the CRT is moved from one location to another having a different magnetic field intensity, the CRT is provided with a magnetic shield. Even in monochrome CRTs having a single electron beam, changes in applied external magnetic field give rise to misalignment of the electron beam raster and the phosphor display area on the CRT's glass faceplate, reducing video image quality.

Magnetic shields may be either internal or external, with the former disposed on the inner surface of the CRT funnel and the latter disposed about the CRT funnel. Prior art internal and external magnetic shields are generally comprised of a soft magnetic material such as aluminum-killed (AK) steel or MOLY-PERMALLOY TM. An internal magnetic shield is inserted in the CRT bulb prior to evacuation and sealing of the CRT and is positioned adjacent to a conductive coating maintained at a high electrical potential on the inner surface of the CRT funnel. The internal magnetic shield sometimes introduces foreign particles in the CRT during manufacture. These contaminants frequently remain in the CRT following manufacture and tend to degrade performance in terms of video image quality and reduced the operating lifetime of the CRT.

Current external magnetic shields comprised of the aforementioned soft magnetic material are subject to rust and are frequently coated with a rust-inhibiting material such as nickel. This coating is expensive and substantially increases the cost of the external magnetic shield. In addition, application of a nickel coating frequently results in manufacturing problems because of inconsistencies in the quality of the nickel coating. Although external magnetic shields are generally more effective than internal magnetic shields, these characteristics make manufacture of CRTs with external magnetic shields more difficult and expensive.

The present invention addresses and overcomes the aforementioned limitations of the prior art by providing an external magnetic shield for a color CRT which is inexpensive, easily installed, and effectively shields the CRT electron beam (or beams) from the influence of external magnetic fields.

OBJECTS OF THE INVENTION

Accordingly, it is an object of the present invention to provide improved video image quality in a CRT.

It is another object of the present invention to provide an external magnetic shield for a CRT to substantially reduce the effect of changes in an external magnetic field on electron beam landing position on the CRT's phosphor screen.

Yet another object of the present invention is to provide a low cost, easily installed and effective external magnetic shield for a color CRT which affords a high degree of video image color purity.

A further object of the present invention is to provide an external magnetic shield particularly adapted for use in the manufacture of color CRTs having a flat glass faceplate and flat tension shadow mask combination.

A still further object of the present invention is to provide an external magnetic shield for a CRT which covers not only the CRT's funnel, but also a portion of its glass faceplate.

BRIEF DESCRIPTION OF THE DRAWINGS

The appended claims set forth those novel features which characterize the invention. However, the invention itself, as well as further objects and advantages thereof, will be understood by reference to the following detailed description of a preferred embodiment taken in conjunction with the accompanying drawings, where like reference characters identify like elements throughout the various figures, in which:

DESCRIPTION OF THE PREFERRED EMBODIMENT

Figure 1:
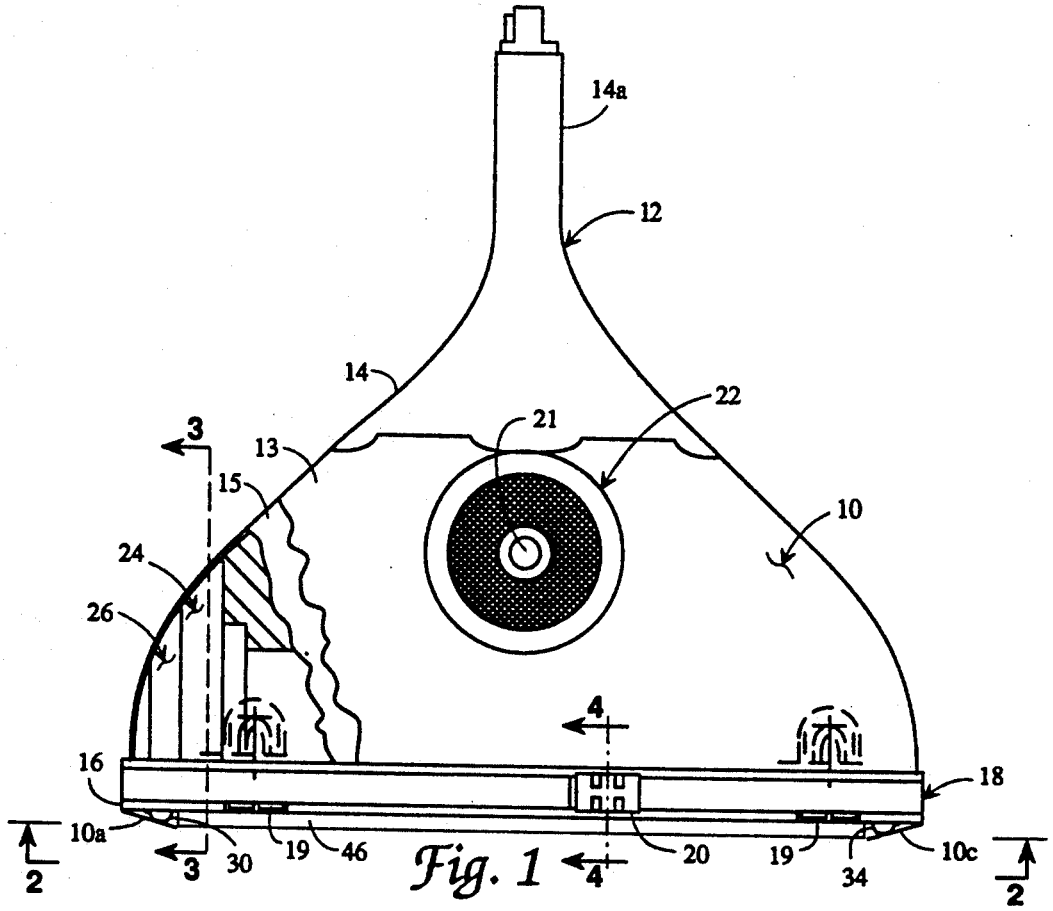
FIG. 1 is a partially cut-away top plan view of a color CRT having a flat glass faceplate incorporating an external magnetic shield in accordance with the present invention.
Figure 2:
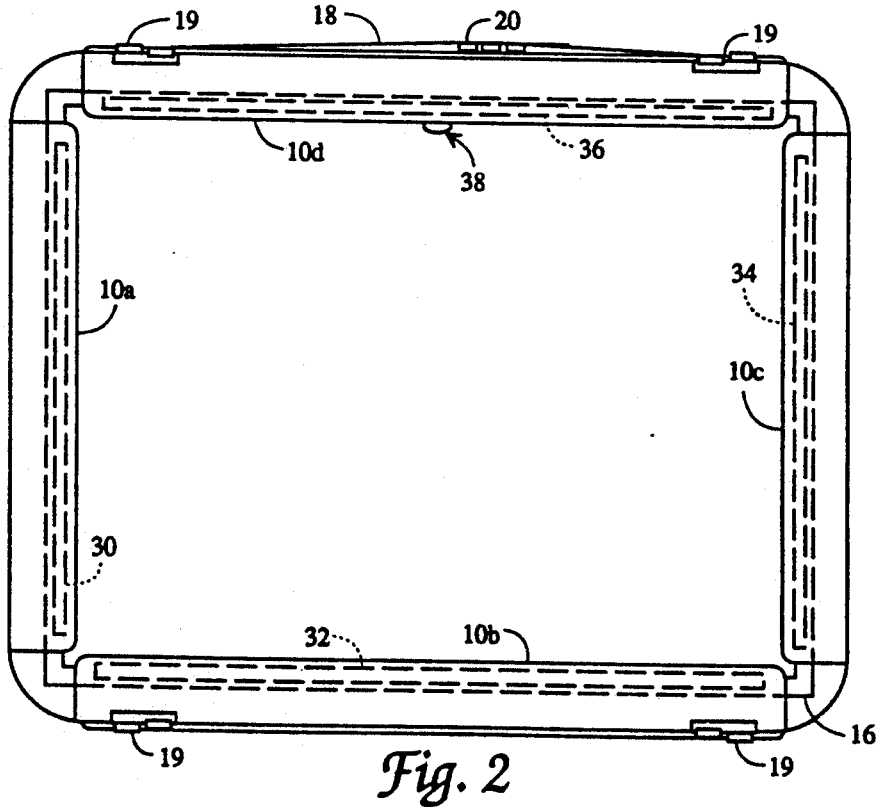
FIG. 2 is a front plan view shown partially in phantom of the CRT incorporating an external magnetic shield of FIG. 1 taken along site line 2—2 therein.

Referring to FIGS. 1 and 2, there are respectively shown top and front plan views of a CRT 12 incorporating an external magnetic shield 10 in accordance with the principles of the present invention. The following description also relies upon FIGS. 3 and 4, which are sectional views of portions of FIG. 1 respectively taken along site lines 3—3 and 4—4 therein.

The CRT 12 includes a funnel 14 and a glass faceplate 16 attached to the forward, enlarged, open end of the funnel. An electron beam source, or sources, (not shown) disposed in the neck portion **14*a* of the funnel directs one or more electron beams toward the CRT's faceplate 16 and onto a phosphorescing screen which includes a large number of phosphor elements for producing a video image on the inner surface of the glass faceplate. The electrons are accelerated by various high voltage potentials applied to control grids (also not shown) within the CRT 12. A high voltage connector 21 inserted through the funnel 14 allows the aforementioned control grids to be electrically coupled to an external high voltage source. An insulating grommet 22 disposed about the high voltage connector 21 and in contact with the external magnetic shield 10 on the outer surface of the funnel 14 provides electrical isolation and insulation for the high voltage connector 21**. Although described herein for use with a color CRT having a flat faceplate and shadow mask combination, the external magnetic shield has equal applicability to more conventional color CRTs having a domed faceplate as well as to single electron beam monochrome CRTs.

A metal tension band 18 is disposed about and in tight fitting engagement with the peripheral edge of the glass faceplate 16. The tension band 18 is maintained in a stretched condition by a clip 20 typically crimped to the tension band. The tension band 18 maintains a compressive force about the peripheral edge of the glass faceplate 16 to provide implosion protection for the CRT 12. A plurality of funnel pads 19 arranged in a spaced manner about the peripheral edge of the glass faceplate 16 and disposed between tension band 18 and external magnetic shield 10 protect the magnetic shield from damage by the tension band arising from funnel alignment marks on the faceplate periphery. An anode 38 is positioned within the CRT funnel 14 and is coupled to the high voltage connector 21 extending through the funnel.

The forward edge of the funnel 14 is securely attached to an aft surface of the glass faceplate 16 about its periphery by conventional means such as a frit seal, or bead, 54. Attached to the forward surface of the glass faceplace 16 by means of an adhesive resin 44 is a transparent safety panel 46. The light transmitting characteristics of the glass faceplate 16, the adhesive resin 44, and the safety panel 46 are matched to ensure the video image is transmitted through these elements without optical distortion. The safety panel 46 prevents outward displacement of the glass faceplate 16, or fragments thereof, upon implosion of the evacuated bulb of the CRT 12. Tape 42 is disposed intermediate each of the corners of the glass faceplate 16 and the tension band bracket 28 to protect the faceplate. A tension band clip 20 includes a plurality of clip crimp tabs 52 for securely attaching the clip to the tension band 18 in maintaining the tension band in a tightly stretched condition about the periphery of the glass faceplate 16. A vinyl tape covering 26 is disposed about a forward portion of the funnel 16 and a peripheral edge portion of the glass faceplate 16. In addition, a copper tape covering 24 is disposed about a forward portion of the funnel 16, the periphery of the glass faceplate 16, and a peripheral portion of the safety panel 46. The vinyl and copper tape coverings 26 and 24 as well as the inclusion of an indium tin oxide layer in the adhesive resin 44 reduces electromagnetic emissions from the CRT for special applications and are not included in CRTs such as used in television receivers and most computer terminals.

Figure 3:
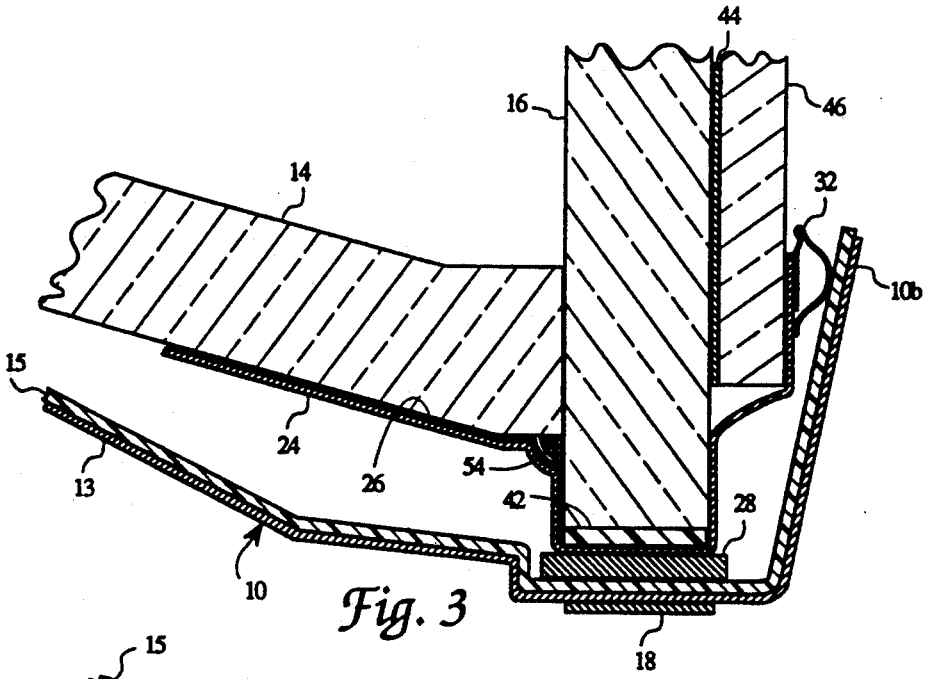
FIG. 3 is a sectional view of the CRT and external magnetic shield combination shown in FIG. 1 taken along site line 3—3 therein.
Figure 4:
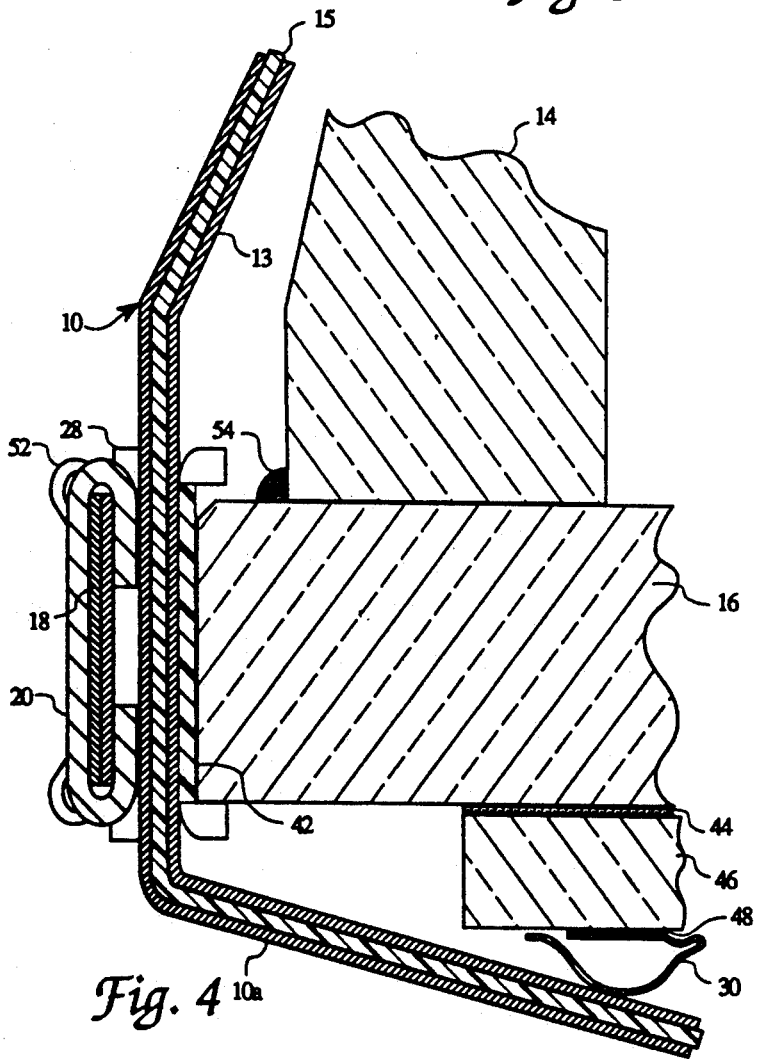
FIG. 4 is a sectional view of a portion of the CRT and external magnetic shield combination shown in FIG. 1 taken along site line 4—4 therein.

In accordance with the present invention, the external magnetic shield 10 is disposed in tight fitting relation about the funnel 14, the periphery of the glass faceplate 16, and a peripheral portion of the safety panel 46. The external magnetic shield 10 includes first, second, third and fourth peripheral flaps 10*a*, 10*b*, 10*c* and 10*d*. Each of the aforementioned peripheral flaps extends from a forward portion of the external magnetic shield 10 and is adapted for folding over a forward peripheral portion of the glass faceplate 16. Thus, FIG. 3 shows a bottom peripheral flap 10*b* of the external magnetic shield 10 folded inwardly toward the glass faceplate 16 so as to overlap a lower peripheral portion thereof. Similarly, the sectional view of FIG. 4 shows one of the lateral flaps 10*a* folded inwardly toward the glass faceplate 16 so as to overlap a lateral peripheral portion thereof. Upper and lower shielding strips 36 and 32 are attached to respective upper and lower portions of the safety panel 46 by means of an adhesive 48. Similarly, lateral shielding strips 30 and 34 are securely attached to lateral edge portions of the safety panel 46. Each of the shielding strips 30, 32, 34 and 36 is positioned in contact with a respective flap of the external magnetic shield 10 for the purpose of preventing EMI/RFI emissions from a forward portion of the CRT 12. While the main portion of the external magnetic shield 10 provides shielding for the funnel portion of the CRT 12, the four forward flaps 10*a*, 10*b*, 10*c* and 10*d* of the magnetic shield provide shielding for peripheral, forward portions of the CRT adjacent to the periphery of the glass faceplate 16.

Figure 5:
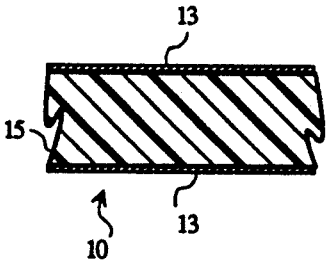
FIG. 5 is a partial sectional view of an external magnetic shield in accordance with the present invention.

As shown particularly in the cut-away portion of FIG. 1 and the partial sectional view of the external magnetic shield 10 of FIG. 5, the magnetic shield is comprised of an inner plastic core 15 having an outer surface coating 13 on facing surfaces thereof. The core 15 of the external magnetic shield 10 is preferably comprised of a relatively high strength plastic capable of withstanding temperatures of up to 150° C. The plastic core 15 of the external magnetic shield 10 may be formed by various conventional methods. For example, the magnetic shield core 15 may be formed by injecting a heated plastic in liquid form into a mold conforming to the outer periphery of the CRT's funnel 14. The plastic is allowed to cure, the mold is removed from the thus formed plastic core, and the plastic core is fitted over the CRT's funnel after being coated with a magnetic material as described below. The magnetic shield core 15 may also be formed by thermal forming a flat piece of plastic into a shape conforming to the outer contour of the CRT funnel 14. Working of the magnetic shield core 15 into the desired shape is accomplished while the core is maintained at an elevated temperature. Another approach to magnetic shield core formation involves the mechanical stamping of a flat piece of heated, moldable plastic sheet into the desired CRT funnel-conforming configuration. This latter approach is the preferred method for forming an external magnetic shield 10 in accordance with the present invention. By installing the external magnetic shield 10 following evacuation and frit sealing of the CRT bulb, which typically occurs at temperatures on the order of 400° C., the present invention is able to make use of inexpensive plastic materials for the magnetic shield which need be capable of withstanding temperatures of only on the order of 150° C. By thus employing an external magnetic shield, the shield assembly may be installed after high temperature frit sealing of the CRT bulb which greatly facilitates shield installation, reduces the possibility of introducing contaminants in the CRT and allows for the use of inexpensive, easily worked plastic materials for the shield.

The magnetic coating 13 is preferably comprised of a soft magnetic material having high magnetic permeability (low reluctance to magnetic flux) and low coercivity (coercive force corresponding to the saturation inductance of the material). Examples of magnetic materials which could be used for the magnetic coating 13 are a nickel-cobalt alloy, Mu metal (77Ni-5Cu-1.5Cr-Fe); 79Ni-21Fe, and 79Ni-4Mo-Fe (MOLY-PERMAL- LOY TM ). These materials may be applied to the outer surface of the plastic core 15 by various well-known techniques. For example, the magnetic coating 13 may be applied as a laminate on the outer surface of the plastic core 15 using a suitable adhesive. The magnetic coating 13 may also be applied to the plastic core 15 by dipping the core into a heated solution containing dust of the soft magnetic material, a solvent, and a binding material. This solution may also be applied to the plastic core 15 by spraying. Another approach for applying the magnetic coating 13 to the plastic core 15 involves vacuum deposition of the magnetic material on the outer surface of the core. Still another approach for coating the magnetic shield's plastic core 15 involves ultrasonic spraying of the magnetic material in powder form. Because the magnetic characteristics of the external magnetic shield are primarily a surface phenomenon rather than dependent upon bulk properties of the material, the magnetic coating 13 is preferably relatively thin, e.g., on the order of 1–2 mil thick, while the core is typically 5–8 mils thick. The magnetic coating 13 is preferably applied to both inner and outer surfaces of the core 15, although the present invention will operate effectively in excluding external magnetic field from within the CRT if only one of the core surfaces is coated.

There has thus been shown an external magnetic shield for a CRT comprised of an inner plastic core and an outer magnetic coating disposed on the core. The external magnetic shield is contoured to match the outer contour of the CRT's funnel and is positioned about the funnel in tight fitting relation. Disposed on forward edges of the magnetic shield are a plurality of flaps adapted for folded positioning over peripheral portions of the CRT's faceplate. Because the external magnetic shield is installed after the high temperature frit sealing cycle of the CRT, the shield's core may be comprised of an easily worked, inexpensive plastic material. A thin layer of a soft magnetic material such as nickel-cobalt alloy or moly-permalloy is used for coating the outer surface of the shield's core and may be applied by various well-known techniques at low cost. The external magnetic shield isolates an electron beam (or beams) within the CRT from external magnetic fields for improved electron beam positioning control on the inner, image-producing surface of the CRT's faceplate.

Figure 6:
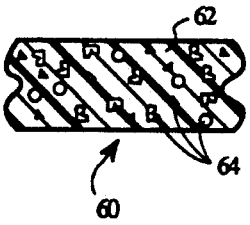
FIG. 6 is a partial sectional view of another embodiment of an external magnetic shield comprised of particles of a soft magnetic material distributed throughout a rigid structure of nonmagnetic material.

While particular embodiments of the present invention have been shown and described, it will be obvious to those skilled in the art that changes and modifications may be made without departing from the invention in its broader aspects. For example, a broader aspect of this invention is shown in FIG. 6 which is a partial sectional view of another embodiment of an external magnetic shield 60 for a CRT in accordance with the present invention. The external magnetic shield 60 is comprised of a shell 62 of nonmagnetic material such as thermoplastic resin and particles 64 of a soft magnetic material such as described above. The soft magnetic material particles 64 could be introduced in the form of dust in the plastic shell 62 prior to curing and hardening of the shell. The external magnetic shield 60 of FIG. 6 provides a uniform, nonlayered structure which substantially prevents the introduction of external magnetic fields into the CRT envelope. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. For use with a cathode ray tube (CRT) having a funnel, a faceplate attached to a forward portion of the funnel and including a plurality of phosphor elements on an inner surface thereof, and an electron gun for directing an electron beam onto the phosphor elements for producing a video image, an magnetic shield comprising:

a non-magnetic shell configured to generally conform to the outside surface of the funnel;

a layer comprised of a soft magnetic material having high magnetic permeability and low coercivity disposed on said shell; and extension means extending from a forward portion of said magnetic shield and disposed over forward peripheral portions of the faceplate.

2. The magnetic shield of claim 1 wherein said extension means comprises a plurality of flaps disposed on a forward portion of said magnetic shield and adapted for folded positioning over forward peripheral portions of the faceplate.

3. The magnetic shield of claim 2 further comprising magnetic shielding means disposed on an outer surface of the faceplate and engaging said flaps for preventing radiation emission from the CRT faceplate.

4. The magnetic shield of claim 3 wherein said magnetic shielding means includes a plurality of elongated, linear strips disposed on an outer surface of the faceplate adjacent to the edges thereof.

5. The magnetic shield of claim 4 further comprising a safety panel disposed on the outer surface of the CRT faceplate and attached to said elongated shielding strips.

6. A method for shielding at least one electron beam in a cathode ray tube (CRT) having a faceplate and a funnel from an external magnetic shield in ensuring that said at least one electron beam is incident on a designated location on an inner surface of the faceplate, said method comprising the steps of:

forming a non-magnetic shell in the general contour of an outer surface of the CRT funnel;

forming on an outer surface of the thus-formed shell a layer of soft magnetic material;

positioning the shell with the outer layer of soft magnetic material over the CRT funnel in tight fitting relationship;

attaching the shell to an outer surface of the CRT funnel; and folding a forward portion of the shell over peripheral edge portions of the CRT faceplate.

7. For use with a cathode ray tube (CRT) having a funnel, a faceplate attached to a forward portion of the funnel and including a plurality of phosphor elements on an inner surface thereof, and an electron gun for directing an electron beam onto the phosphor elements for producing a video image, an magnetic shield for shielding the electron beam from external magnetic fields, said magnetic shield comprising:

a nonmagnetic shell configured to generally conform to the outside surface of the funnel;

extension means disposed on a forward portion of said shell and covering a forward peripheral portion of the faceplate; and a layer comprised of a soft magnetic material having high magnetic permeability and low coercivity disposed on said shell and said extension means.

* * * * *